US005146964A

United States Patent [19]

Dietz

[11] Patent Number: 5,146,964

[45] Date of Patent: Sep. 15, 1992

[54] APPARATUS AND METHOD FOR CUTTING OR SLOTTING RIGID MATERIAL, IN PARTICULAR WOOD

[75] Inventor: Hans Dietz, Ammerbuch, Fed. Rep. of Germany

[73] Assignee: Wurster u. Dietz GmbH u. Co., Tubingen-Derendingen, Fed. Rep. of Germany

[21] Appl. No.: 787,224

[22] Filed: Nov. 4, 1991

[30] Foreign Application Priority Data

Nov. 5, 1990 [DE] Fed. Rep. of Germany ..... 4035048

[51] Int. Cl.[5] ..... B27G 19/08; B26D 7/08; B27B 1/00; B27B 5/28

[52] U.S. Cl. ..... 144/363; 83/102.1; 83/105; 83/676; 144/369

[58] Field of Search ..... 144/182, 183, 184, 185-192, 144/363, 369, 193 R; 83/102.1, 105, 671, 676, 871

[56] References Cited

U.S. PATENT DOCUMENTS

| | | | |
|---|---|---|---|
| 4,503,892 | 3/1985 | Gonner | 144/184 |
| 4,589,458 | 5/1986 | Traben | 144/184 |
| 4,896,708 | 1/1990 | Dietz | 83/102.1 |
| 5,052,452 | 10/1991 | Goenner | 144/357 |

FOREIGN PATENT DOCUMENTS

| | | | |
|---|---|---|---|
| 3623235 | 7/1986 | Fed. Rep. of Germany . | |
| 26964 | 6/1915 | Norway | 144/182 |

*Primary Examiner*—W. Donald Bray
*Attorney, Agent, or Firm*—Poms, Smith, Lande & Rose

[57] ABSTRACT

An apparatus and a method serve for cutting elongate pieces of wood having a modulus of elasticity between 50,000 and 400,000 kg/cm$^2$. A circular saw blade is provided having a plurality of spaced peripheral teeth. The saw blade is rotated about an axis at a cutting speed exceeding 40 m/s. The pieces of wood are displaced relative to the saw blade along a feeding direction extending perpendicular to the saw blade axis of rotation. A stationary bending element is arranged on a broad side of the saw blade adjoining the cutting teeth. The bending element has a radially profiled surface with at thickness increasing towards the axis and decreasing towards the cutting teeth. The saw blade can be used to cut a slot into the pieces of wood along the feeding direction, thus generating a first and a second section of the pieces of wood. The bending element ensures that the first section is lifted from the saw blade immediately after the formation of the slot. A deflection element is arranged at a first distance from the bending element downstream along the feeding direction. The deflection element exerts a first force on a first surface of the first section facing away from the bending element. A supporting element is arranged at a second distance from the bending element downstream along the feeding direction with the second distance being smaller than the first distance. The supporting element exerts a second force on a second surface of the first section facing the bending element.

5 Claims, 2 Drawing Sheets

Figure 1:
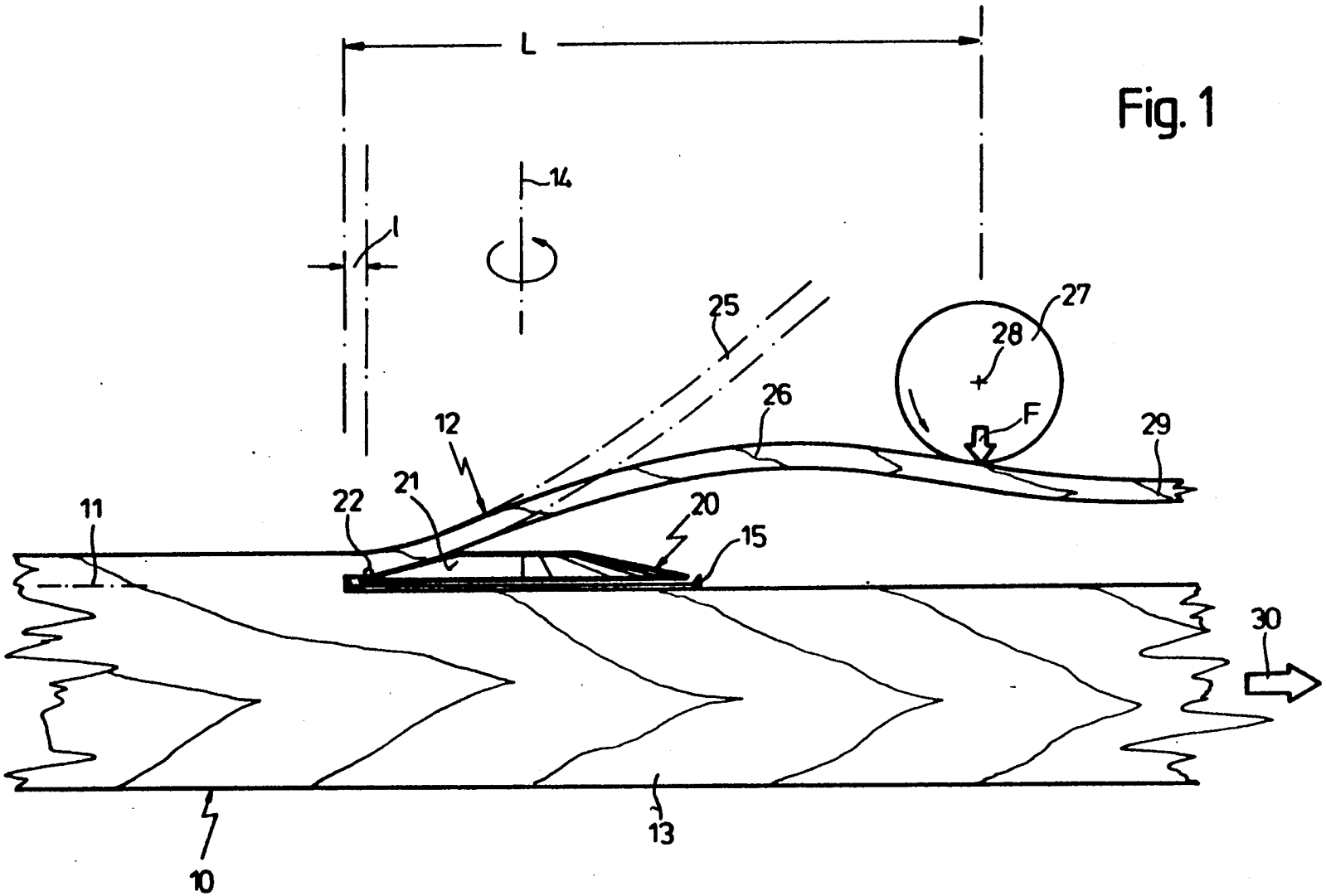

L
l
14
12
21
22
25
26
27
28
F
29
20
15
30
13
10
11

APPARATUS AND METHOD FOR CUTTING OR SLOTTING RIGID MATERIAL, IN PARTICULAR WOOD

The invention relates to an apparatus and a method for cutting or slotting rigid material, in particular wood, said material having a modulus of elasticity between 50,000 and 400,000 kg/cm$^2$.

An apparatus and a method of this kind are disclosed in U.S. Pat. specification No. 4,896,708 assigned to the assignee of this application, the disclosure thereof being incorporated herein by reference.

The prior art apparatus and method make use, preferably, of a circular saw having a circular saw blade. A stationary bending or cleaving element is provided which is configured as a conically tapering, non-rotating collar, which is arranged concentrically relative to the circular saw blade. It is ensured by means of this arrangement, for example, when cutting off a board from one side of a main wood timber, that once the teeth of the circular saw blade have passed the lateral board, the latter will run up upon the stationary cleaving element and will be bent out of the cutting plane. Thus, any further friction between the cut-off lateral board and the rotating circular saw blade is prevented, thereby considerably reducing the build-up of heat in the area of the circular saw blade.

Now, it has been found that a section, or lateral board, which is deflected in this way from the cleavage plane moves away too far laterally from the remainder of the material to be cut, because, after having been bent off, the section tends to return to its straight shape so that it will stand off at an angle relative to the feeding direction of the material to be cut.

The inventor has, therefore, performed experiments with a deflection device tending to bring the laterally projecting section back to a direction corresponding substantially to the feeding direction of the material to be cut. However, this manner of proceeding is not fully uncritical since the deflection device gives rise to increased contact pressure between the section and the cleaving element. In the case of a stationary cleaving element, this local overloading occurs always at the same point, i.e. at the point where the section runs up against the cleaving element, which leads to fatigue of the material at this point, as has been shown by corresponding trials.

Now, it is the object of the present invention to improve a device of the before-described kind in such a way that the cut-off sections can be guided in an orderly way in the feeding direction of the material to be cut, without this leading to mechanical overloading of the cleaving element.

This object is achieved according to the invention by a deflection device arranged at a first distance from the cleaving element, in the feeding direction of the material to be cut, and exerting a force on that surface of the section which faces away from the cleavage plane; and a supporting system which is arranged at a second distance from the cleaving element smaller than the first distance and which exerts a force upon that surface of the section which faces the cleavage plane.

This solves the object underlying the present invention fully and perfectly. For, the deflection device has the desired result that the bent-off section is returned to a path, or a direction, which corresponds to the feeding direction of the material to be cut so that the cut-off material can be further worked within the frame of an overall working system for the material to be cut. On the other hand, the disadvantages described above, namely possible local overloading of the cleaving element, are avoided by the supporting system because the latter is capable of absorbing part or even all of the load exerted by the deflecting device on the cleaving element, via the bent-off section. The supporting system as such offers much greater possibilities to arrive at a low-friction design than the cleaving element itself, as the cleaving element has to be arranged, and to perform its spreading-apart function, within an extremely confined space in the direct neighborhood of the tool. This restricts the constructional possibilities for the design of the cleaving element quite considerably.

According to a particularly preferred embodiment of the invention, the supporting system is in rolling-frictional contact with the section.

This feature provides the advantage that a particularly low-friction support is rendered possible so that the local loading of the cleaving element, due to the effect of the deflection device, is not only divided between the cleaving element and the supporting means, but is in addition notably reduced altogether.

According to another preferred embodiment of the invention, the torques exerted upon the section relative to the cleaving element by the supporting system on the one hand and the deflection device on the other hand, are substantially balanced out one by the other.

This feature provides the advantage that the local loading of the cleaving element is reduced to the amount which is absolutely unavoidable in order to bend the section off the cleavage plane.

Another embodiment of the invention is characterized by the fact that the supporting system comprises a roller train which is arranged directly behind the cleaving element in the feeding direction of the material to be cut and which guides the section perpendicularly to the feeding direction and along a path which corresponds to the natural deflection of the section at the cleaving element that would result in the absence of the deflection device and the supporting system.

This feature provides the advantage that the area of the section upstream of the deflection device and the supporting system is absolutely free from any forces, related to the forces exerted upon the section by the deflection device and the supporting system.

Other advantages of the invention will appear from the specification and the attached drawing.

It is understood that the features that have been described before and will be explained hereafter may be used not only the described combinations, but also in any other combination, or individually, without leaving the scope and intent of the present invention.

Figure 2:
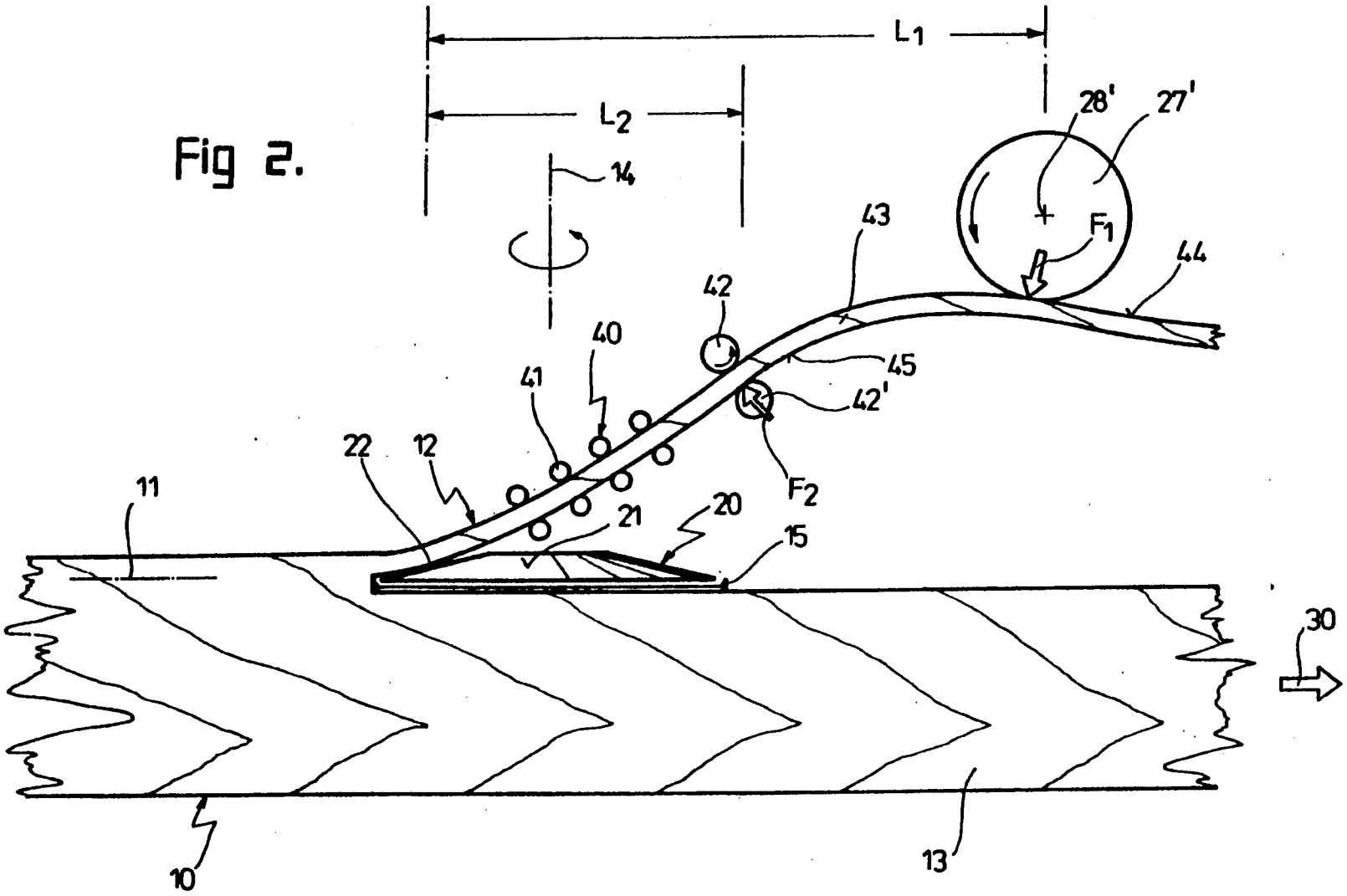

Certain embodiments of the invention will now be described in more detail with reference to the drawing in which:

FIG. 1 shows a—partly sectional—side view of a device comprising a circular saw for cutting-off a lateral board from the main material; and FIG. 2 shows a device similar to that of FIG. 1, but equipped with all the features according to the invention.

Regarding now the figures, a material to be cut, in the illustrated example a sectional timber—i.e. a log or some other surface-worked timber shape—is indicated generally by reference numeral 10. The illustrated device is intended for cutting-off a section 12, i.e. in the illustrated example a lateral board, from the remaining material 13, in the present case the remaining main material, along a cleavage plane 11.

There is provided for this purpose a circular saw blade 15 rotating about an axis 14 and located in the cleavage plane 11.

The rotating circular saw blade 15 is surrounded, relative to the axis 14, by a stationary cleaving element 20 of flat conical shape. The cleaving element 20 is provided on its feed side with a conical running-up surface 21 which corresponds to the contact area or contact point 22 of the abutting section 12.

Due to the conical shape of the cleaving element 20, the cut-off section 12 is bent off the cleavage plane 11, as indicated by the dash-dotted lines 25 in FIG. 1.

The device according to the invention corresponds insofar fully to that described by the same applicant's before-mentioned WO 88/02683. For further details, reference is made to that publication whose disclosure content is incorporated herein by reference.

The first shape 25 illustrated by the dash-dotted lines in FIG. 1 is connected with the disadvantage that the cut-off section 12 stands out in oblique direction from the remaining material 13.

In order to obtain a second shape 26, which is represented by full lines in FIG. 1, some deflection means may be employed. This deflection means may consist, for example, of a deflection roller 27 which is arranged to rotate about an axis 28 and which bears upon a forward portion 29 of the cut-off and spread-apart section 12. The deflection roller then exerts upon the forward portion 29 the section 12 a force F acting in the direction of the cleavage plane 11.

In the illustrated example, the circular saw blade 15 is mounted on a stationary circular saw. Consequently, the material to be cut 10 has to be advanced along the cleavage plane 11, in the direction indicated by arrow 30. Now, the illustrated and discussed deflection system has the effect that the forward portion 29 is also advanced substantially in the direction 30, i.e. in parallel to the remaining material 13 being advanced.

As will be readily appreciated from FIG. 1, the deflection system also has the effect of a lever. If one regards the system in an abstract way, taking the cut-off and spread-apart section 12 as the lever and the point of attack of the circular saw blade 15 at the material 10 as the point of articulation, then the force F of the deflection roller 27 acts relative to this point of articulation across a lever arm L corresponding to the distance between the axis 28 and the point of attack of the circular saw blade 15, measured in the direction 30. On the other hand, the point or area of contact 22 is located at a very small distance 1 from this point of attack. One therefore obtains a two-armed lever where the deflection force F is translated, by the very important ratio L/1, into an additional force acting in the contact area 22 between the section 12 and the cleaving element 20. To say it in other words: The deflection device, therefore, results in an additional load being exerted upon the cleaving element 20 in the contact area. If the arrangement of the cleaving element 20 is selected to be stationary, instead of rotating,—this being preferred—then it is always the same surface area of the cleaving element 20 which is subjected to this overloading, with the result that overheating and, thus, fatigue of the material, connected with increased wear, may occur.

In order to remedy these disadvantages, an additional supporting device is proposed according to FIG. 2. Comparing the representations of FIG. 1 and of FIG. 2, the same reference numerals have been used for identical elements.

As will be readily seen, the cleaving element 20 is directly followed, in downstream direction, by a roller train 40 comprising first rollers 41 and second rollers 42 between which the spread-apart section 12 is guided. Having passed the roller train 40, the section 12 reaches again the area of a deflection device comprising a deflection roller 27' arranged to rotate about an axis 28'.

Regarding now only the deflection roller 27' and the second rollers 42 and 42', it will be easily appreciated that the deflection roller 27' exerts a force $F_i$ upon the section 12, i.e. upon its surface 44 facing away from the cleavage plane 11. On the other hand, the lower roller 42' exerts a force $F_2$ upon the section 12, but this time on a surface 45 facing toward the cleavage plane 11.

If one assumes that the point of attack of the force $F_i$ is spaced, in the feeding direction 30, from the contact area 22 between the section 12 and the cleaving element 20 by the length $L_1$, and that the corresponding distance of the point of attack of the force $F_2$ on the section 12 is equal to $L_2$, then it will be easily understood that the cleaving element 20 can be relieved in the contact area by a suitable adjustment of the forces $F_1$ and $F_2$. If, for example, the force $F_2$ is adjusted in such way that the active torque about the contact area 22 has exactly the same, but inverse, amount as the torque exerted by the force $F_1$, then the effect of the deflection roller 27' on the cleaving element 20 would be just compensated by the roller 42'.

It is further important in this connection that the roller 42' exerts upon the section 12 only a rolling friction so that the load-relieving effect for the contact area 22 results in an effective reduction of the total friction.

It is further preferred in this connection if the second rollers 42 are preceded by the first rollers 41. The first rollers 41 preferably are arranged in such a way that the path of movement defined by them for the section 12 corresponds to the natural bending line of the section 12, after the latter has been bent off in the contact area 22. If the arrangement is selected in this way, then the section 12 leaves the roller train formed by the first rollers 41 absolutely free from any forces, so that a force acting upon the section 12 in a substantially radial direction, at a point downstream of the first rollers 41, will not affect the portion of the section 12 which is still upstream of the first rollers 41.

It will be apparent from the above explanations that the first rollers 41 and the second rollers 42 can be used individually, though preferably they are employed in combination.

It is understood that for the sake of improved clarity and better understanding, FIGS. 1 and 2 illustrate the arrangement only in an extremely diagrammatic way, without showing the relative sizes. In practice, the arrangement and number of the deflection and supporting rollers will have to be determined according to the particular circumstances, which may depend on the kind of material to be cut, i.e. the material or kind of wood to be worked, and also on the thickness of the section to be cut off.

I claim:

1. An apparatus for cutting elongate pieces of wood, said pieces of wood having a modulus of elasticity between 50,000 and 400,000 kg/cm$^2$, comprising:

a circular saw blade having a plurality of spaced peripheral teeth;

drive means for rotating said saw blade about an axis at a cutting speed of said teeth exceeding 40 m/s;

feeding means for displacing said pieces of wood relative to said saw blade along a feeding direction extending perpendicularly to said axis;

stationary bending means arranged on a broad side of said circular saw blade adjoining said cutting teeth, said stationary bending means having a radially profiled surface with a thickness increasing towards said axis and decreasing towards said cutting teeth, whereby said saw blade can be used to cut a slot into said pieces of wood along said feeding direction thus generating a first and a second section of said pieces of wood, and whereby said first section is lifted from said saw blade immediately after the formation of said slot;

deflection means arranged at a first distance ($L_1$) from said stationary bending means downstream along said feeding direction, said deflection means exerting a first force ($F_1$) on a first surface of said first section facing away from said stationary bending means; and supporting means arranged at a second distance ($L_2$) from said stationary bending means downstream along said feeding direction with said second distance ($L_2$) being smaller than said first distance ($L_1$), said supporting means exerting a second force ($F_2$) on a second surface of said first section facing said stationary bending means.

2. The apparatus of claim 1, wherein said supporting means comprises rollers contacting and supporting said first section.

3. The apparatus of claim 1, wherein a first torque corresponding to said first force ($F_1$) times said first distance ($L_1$) is substantially equal to a second torque corresponding to said second force ($F_2$) times said second distance ($L_2$).

4. The apparatus of claim 1, wherein said supporting means comprises rollers, said rollers being configured as a roller train contacting said first section on both said first and said second surfaces for guiding said first section after having passed said stationary bending means along a path corresponding to a natural bending curve of said first section as would appear on said first section in the absence of said deflection means and of said supporting means.

5. A method of cutting wood, comprising the steps of:

selecting an elongate piece of wood having a modulus of elasticity between 50,000 and 400,000 kg/cm$^2$;

cutting an elongate slot into said piece of wood using a circular saw blade having a plurality of spaced peripheral cutting teeth at a cutting speed exceeding 40 m/s along an infeed direction of said piece of wood relative to said saw blade, thereby dividing said piece of wood into a first and a second section;

bending said first section away from said slot to lift off said first section from said saw blade immediately after the formation of said slot;

deflecting said first section at a first distance from said cutting teeth downstream along said feeding direction by exerting a first force on a first surface of said first section facing away from said cutting teeth; and supporting said first section at a second distance from said cutting teeth downstream along said feeding direction with said second distance being smaller than said first distance, by exerting a second force on a second surface of said first section facing said cutting teeth.

* * * * *